US010458735B2

(12) United States Patent
Yoon et al.

(10) Patent No.: US 10,458,735 B2
(45) Date of Patent: Oct. 29, 2019

(54) COMBINED LOADING DEVICE AND COMBINED LOADING METHOD FOR SHELL AND CHARGE

(71) Applicant: HANWHA DEFENSE CO., LTD., Changwon-si (KR)

(72) Inventors: Young Ki Yoon, Changwon-si (KR); Jae Yi Oh, Changwon-si (KR)

(73) Assignee: HANWHA DEFENSE CO., LTD., Changwon-si (KR)

( * ) Notice: Subject to any disclaimer, the term of this patent is extended or adjusted under 35 U.S.C. 154(b) by 0 days.

(21) Appl. No.: 15/769,554

(22) PCT Filed: Sep. 27, 2016

(86) PCT No.: PCT/KR2016/010807
§ 371 (c)(1),
(2) Date: Apr. 19, 2018

(87) PCT Pub. No.: WO2017/104948
PCT Pub. Date: Jun. 22, 2017

(65) Prior Publication Data

US 2018/0313620 A1 Nov. 1, 2018

(30) Foreign Application Priority Data

Dec. 17, 2015 (KR) ..... 10-2015-0181081

(51) Int. Cl.
*F41A 9/00* (2006.01)
*F41A 9/04* (2006.01)
(Continued)

(52) U.S. Cl.
CPC *F41A 9/04* (2013.01); *F41A 9/01* (2013.01); *F41A 9/09* (2013.01); *F41A 9/16* (2013.01);
(Continued)

(58) Field of Classification Search
CPC .... F41A 9/16; F41A 9/04; F41A 9/375; F41A 9/45; F41A 9/46
(Continued)

(56) References Cited

U.S. PATENT DOCUMENTS 2,403,882 A * 7/1946 Thomas ..... F41A 9/04 89/46
2,971,438 A * 2/1961 Fox ..... F41A 9/01 198/468.2
(Continued)

FOREIGN PATENT DOCUMENTS

EP 0178484 A1 4/1986
EP 2180284 A2 4/2010
(Continued)

OTHER PUBLICATIONS

International Search Report, issued by International Searching Authority in corresponding International Application No. PCT/KR2016/010807, dated Dec. 29, 2016 (PCT/ISA/210).
(Continued)

*Primary Examiner* — Michael D David
(74) *Attorney, Agent, or Firm* — Sughrue Mion, PLLC

(57) ABSTRACT

Provided are a combined loading device and method. The combined loading device includes a first housing in which a shell is inserted; a second housing in which a charge is inserted, the second housing being connected to the first housing; a first support located in the first housing and configured to allow the shell or the charge to be seated thereon and linearly moved; and a driving unit located inside the first housing, connected to the first support, and configured to move the first support on which the shell is seated.

9 Claims, 21 Drawing Sheets

(51) Int. Cl.

| | |
|---|---|
| ***F41A 9/01*** | (2006.01) |
| ***F41A 9/38*** | (2006.01) |
| ***F41A 9/39*** | (2006.01) |
| ***F41A 9/43*** | (2006.01) |
| ***F42B 5/38*** | (2006.01) |
| ***F41A 9/09*** | (2006.01) |
| ***F41A 9/16*** | (2006.01) |
| ***F41A 9/37*** | (2006.01) |
| *F41F 1/06* | (2006.01) |

(52) U.S. Cl.
CPC ..... *F41A 9/375* (2013.01); *F41A 9/38* (2013.01); *F41A 9/39* (2013.01); *F41A 9/43* (2013.01); *F42B 5/38* (2013.01); *F41F 1/06* (2013.01)

(58) Field of Classification Search
USPC ..... 89/45, 46, 47, 37.05, 1.3; 42/51
See application file for complete search history.

(56) References Cited

U.S. PATENT DOCUMENTS 4,457,209 A * 7/1984 Scheurich ..... F41A 9/14 89/34
4,489,639 A * 12/1984 Winkler ..... F41A 9/16 89/36.13
4,494,441 A * 1/1985 Magnuson ..... F41A 9/45 89/38
4,669,357 A * 6/1987 von Laar ..... F41A 9/45 89/1.3
4,706,544 A 11/1987 Zielinski et al.
4,836,085 A * 6/1989 Winkler ..... F41A 9/76 89/36.13
4,872,391 A * 10/1989 Stoner ..... F41A 9/42 89/155
4,947,728 A * 8/1990 Muhlhausen ..... F41A 9/09 89/46
4,982,646 A * 1/1991 Machmer ..... F41A 3/74 89/1.3
5,048,393 A * 9/1991 Grabner ..... F41A 9/38 24/453
5,050,479 A * 9/1991 Heintz ..... F41A 9/16 89/1.3
5,107,751 A * 4/1992 Grabner ..... F41A 9/375 89/34
5,111,730 A * 5/1992 Grabner ..... F41A 9/22 89/45
5,111,731 A * 5/1992 Grabner ..... F41A 9/42 89/46
5,337,649 A * 8/1994 Franzen ..... F41A 1/00 102/705
6,460,448 B1 10/2002 Zangrando
6,742,436 B2 6/2004 Grange et al.
2010/0263526 A1 10/2010 Heldmann

FOREIGN PATENT DOCUMENTS

KR 100256535 B1 5/2000
KR 100302461 B1 9/2001
KR 100346894 B1 8/2002
KR 200464852 Y1 1/2013
KR 101374920 B1 3/2014

OTHER PUBLICATIONS

Written Opinion issued by the International Searching Authority in corresponding International Application No. PCT/KR2016/010807, dated Dec. 29, 2016 (PCT/ISA/237).

* cited by examiner

COMBINED LOADING DEVICE AND COMBINED LOADING METHOD FOR SHELL AND CHARGE

TECHNICAL FIELD

The present disclosure relates to a device and a method, and more particularly, to a combined loading device and a combined loading method.

BACKGROUND ART

A firing unit such as a cannon or self-propelled artillery needs to be loaded with a shell and a charge to fire on a target. A shell may be loaded into a gun barrel first, and then a charge may be loaded behind the shell. The shell and charge may be inserted into the gun barrel of a firing unit using a mechanical or human force.

While the shell is usually loaded into the gun barrel using an automatic loading apparatus, the charge is loaded into the gun barrel using a human force since the charge may be damaged when a device for loading a shell is used because the charge is lighter and softer than the shell. In particular, when an excessive force is applied to the charge, the charge may explode and impact the surroundings.

Automatic loading apparatuses are disclosed in detail in KR Patent Publication No. 1999-0003881 (entitled "A Shell Automatic Loading Apparatus of a Small Turret Tank", Applicant: Hyundai Precision & Industries Corporation) and KR Patent Publication No. 1998-0010997 (entitled "Automatic Loading Apparatus of a Breech-Gun for Tank & Clamp for the Same").

DISCLOSURE

Technical Problem

Provided are a combined loading device and a combined loading method.

Technical Solution

According to an aspect of the present disclosure, a combined loading device includes a first housing in which a shell is inserted; a second housing in which a charge is inserted, the second housing being connected to the first housing; a first support located in the first housing to allow the shell or the charge to be seated and linearly moved; and a driving unit located inside the first housing and connected to the first support to move the first support on which the shell is seated.

The driving unit may include a first driving unit connected to the first support to linearly move the first support.

The driving unit may further include a second driving unit located between the first housing and the first support and configured to move the first support via an elastic force.

The combined loading device may further include a second support at an outer surface of the first support, wherein a portion of the second driving unit penetrates through the second support.

The combined loading device may further include a first driving unit located between the second support and one surface of the first housing and configured to move the first support.

The driving unit may include a second driving unit located between the second support and the first housing and configured to apply an elastic force to the second support.

The first driving unit may include a first chain connected to the first support; a second chain connected to the first support and located to face the first chain; and a chain driver configured to combine the first chain and the second chain into a zipper chain and apply a force to the first support.

The combined loading device may further include a transfer unit configured to transfer the charge inserted in the second housing to the first housing.

According to another aspect of the present disclosure, a combined loading method includes inserting a shell into an opening of a first housing and seating the shell on a support; inserting a charge in a second housing connected to the first housing; loading the shell into a gun barrel by linearly moving the support on which the shell has been seated; seating the charge on the support; and loading the charge into the gun barrel by linearly moving the support on which the charge is seated.

A force applied to the support when the charge is loaded is less than a force applied to the support when the shell is loaded.

Advantageous Effects

According to embodiments of the present disclosure, a shell and a charge may be automatically loaded into a gun barrel using a single device. In addition, the shell and charge may be loaded using different forces, so that the charge may be loaded into a gun barrel without being damaged.

MODE OF DISCLOSURE

Figure 1:
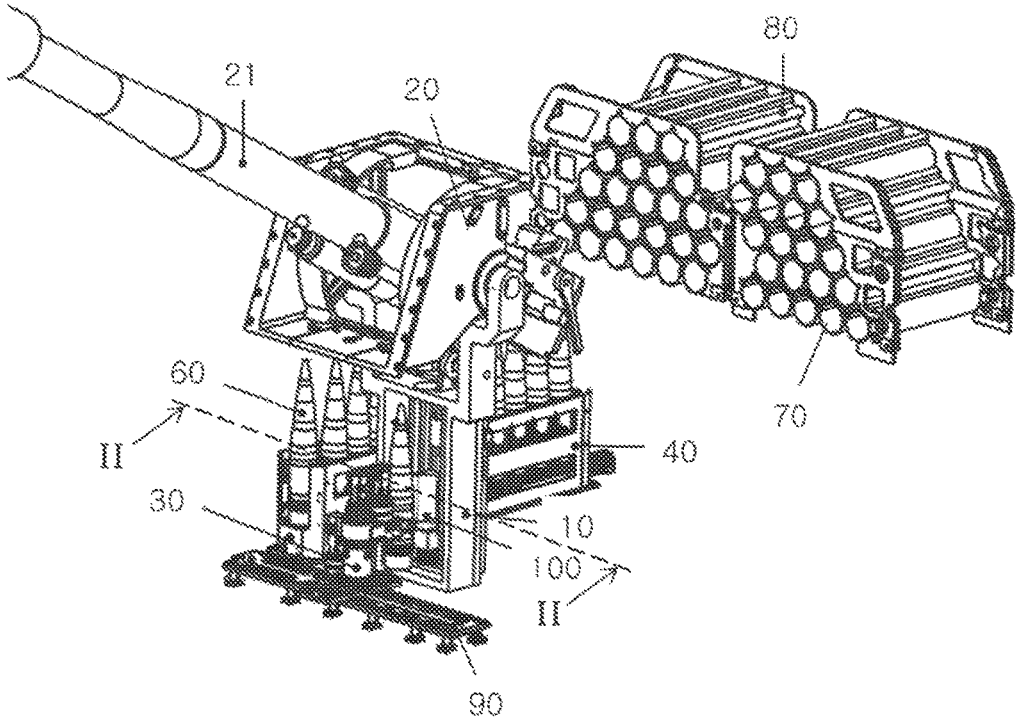
FIG. 1 is a perspective view showing a combined loading device according to an embodiment of the present disclosure.

Embodiments of the present disclosure will be described in detail with reference to the accompanying drawings so as to be easily realized by one of ordinary skill in the art to which this present disclosure belongs. Like reference numerals in the drawings denote like elements.

FIG. 1 is a perspective view showing a combined loading device according to an embodiment of the present disclosure.

An artillery 20, a combined loading device 10, an automatic shell transfer device 30, an automatic shell transfer rail 90, and an automatic charge transfer rack 80 are illustrated in FIG. 1.

The artillery 20 shoots far a shell 60 using the explosive force of gunpowder. The artillery 20 may be a field gun, a mortar, or a self-propelled gun. The artillery 20 is loaded with the shell 60 and a charge 70 and shoots the shell 60 using the explosive force of the charge 70. Loading is completed when the charge 70 is inserted in the artillery 20 after the shell 60 is inserted in the artillery 20.

The combined loading device 10 lifts the shell 60 and the charge 70 to a gun barrel 21 of the artillery 20 using a driving force and loads the shell 60 and the charge 70 into the gun barrel 21. The combined loading device 10 may load the shell 60 and the charge 70 in a separate space. The combined loading device 10 may rotate around a portion coupled to the gun barrel 21. The combined loading device 10 may rotate to be vertical to the ground so that the shell 60 is inserted in the combined loading device 10. After the shell 60 is inserted, the combined loading device 10 may rotate to be horizontal to the ground so that the charge 70 is inserted in the combined loading device 10. At least one charge 70 may be inserted in the combined loading device 10. The number of charges 70 may vary with the flight distance of the shell 60. After the shell 60 and the charge 70 are inserted in the combined loading device 10, the combined loading device 10 rotates to be aligned with the length direction of the gun barrel 21 so as to load the shell 60 and the charge 70. In detail, when the gun barrel 21 makes a certain angle with respect to ground, the combined loading device 10 also makes the same angle with respect to ground.

A shell rack 40 moves the shell 60 to the shell transfer rail 90. A plurality of shells 60 are loaded into the shell rack 40. The shell rack 40 moves the shells 60 sequentially to the shell transfer rail 90 so that the automatic shell transfer device 30 may grab each shell 60.

The shell transfer rail 90 may linearly move the automatic shell transfer device 30. The shell transfer rail 90 may linearly move the automatic shell transfer device 30 using the torque of a motor, a conveyor belt, a ball screw, and a rack gear.

The automatic shell transfer device 30 grabs and inserts the shell 60 in the combined loading device 10. The automatic shell transfer device 30 grabs the shell 60 out of the shell rack 40 and moves horizontally along the shell transfer rail 90. The automatic shell transfer device 30 may horizontally move to a position facing the combined loading device 10 and insert the shell 60 into a side of the combined loading device 10. The automatic shell transfer device 30 may move the shell 60 in a direction horizontal to the ground using a hydraulic or pneumatic cylinder or motor.

The charge 70 is loaded into the automatic charge transfer rack 80. The automatic charge transfer rack 80 may automatically insert at least one charge 70 in the rear of the combined loading device 10 when the combined loading device 10 becomes horizontal to the ground.

Figure 2:
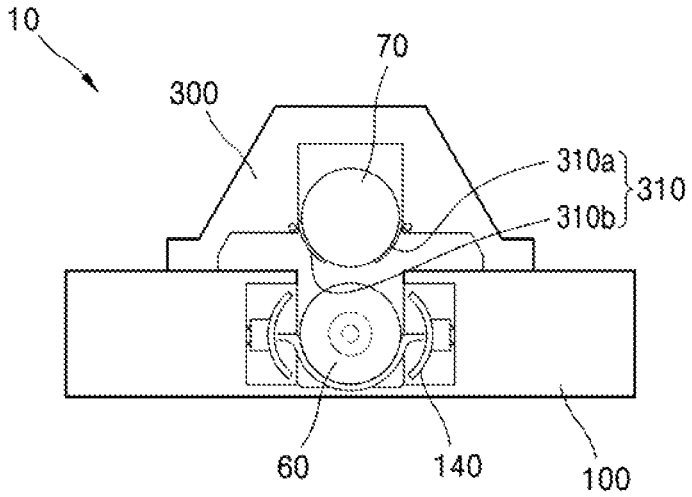
FIG. 2 is a cross-sectional view taken along line II-II in FIG. 1.
Figure 3:
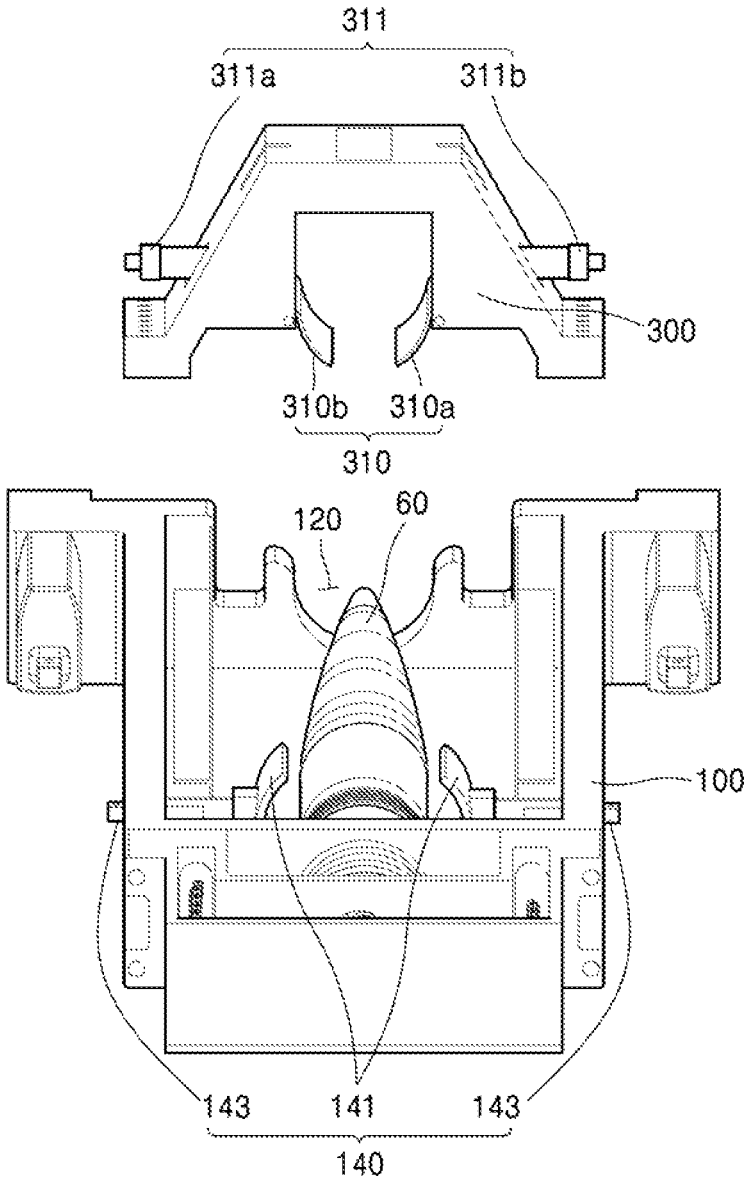
FIG. 3 is a perspective view of a first housing and a second housing shown in FIG. 1.

FIG. 2 is a cross-sectional view, taken along line II-II in FIG. 1. FIG. 3 is a perspective view of a first housing and a second housing shown in FIG. 1.

Referring to FIGS. 2 and 3, the combined loading device 10 includes a transfer unit 310 between a first housing 100 and a second housing 300.

The shell 60 may be inserted into a side of the first housing 100 and loaded into the inside of the first housing 100. The first housing 100 provides a path through which the shell 60 may be linearly moved to the gun barrel 21. The first housing 100 may include a through-hole 120 in a surface facing the gun barrel 21 so that the shell 60 may be passed through the through-hole 120. The first housing 100 may include a driving unit 200 which may lift the shell 60 or the charge 70. When the shell 60 is loaded into the gun barrel 21, the first housing 100 is positioned to be in line with the length direction of the gun barrel 21 so that the shell 60 may be passed through the through-hole 120 and loaded into the gun barrel 21.

The second housing 300 is located on one surface of the first housing 100. The charge 70 may be inserted into a side of the second housing 300. At least one charge 70 may be loaded into the second housing 300. The transfer unit 310 is located at an interface between the first housing 100 and the second housing 300. The transfer unit 310 supports the charge 70 inserted in the second housing 300 so that the charge 70 may be loaded into the second housing 300. The transfer unit 310 may selectively connect the inside of the first housing 100 to the inside of the second housing 300 so that the charge 70 may be moved to the first housing 100. In this case, the first housing 100 faces the ground and the second housing 300 is located higher than the first housing 100.

According to an embodiment, after the shell 60 is loaded into the first housing 100 and the charge 70 is loaded into the second housing 300, the combined loading device 10 is positioned to be aligned with the length direction of the gun barrel 21 (FIG. 1) so as to load the shell 60 and the charge 70 into the gun barrel 21.

The transfer unit 310 supports the charge 70 so that the charge 70 is positioned inside the second housing 300. The second housing 300 is located higher than the first housing 100, and therefore, when the transfer unit 310 opens a passage between the first housing 100 and the second housing 300, the charge 70 may be moved to the first housing 100 by the gravity. The transfer unit 310 may open or close the passage through which the charge 70 may be moved between the first housing 100 and the second housing 300. The transfer unit 310 may move a plurality of charges 70 to the second housing 300 at one time. The transfer unit 310 includes an opening and closing driver which opens and closes plates. The opening and closing driver may move the plates to the horizontal direction of the interface between the first housing 100 and the second housing 300 using a linear motor or a hydraulic or pneumatic cylinder so as to form a passageway between the first housing 100 and the second housing 300. Alternatively, the opening and closing driver may rotate the plates toward the first housing 100 to form a passageway between the first housing 100 and the second housing 300. The opening and closing driver may include any device which moves the transfer unit 310.

According to an embodiment, the transfer unit 310 may move the charge 70 to the first housing 100 by opening and closing two plates between the first housing 100 and the second housing 300. The plates may rotate toward the first housing 100 or linearly move in the length direction of the plates to open the passageway. The plates are long in the length direction of the second housing 300. The plates may support a plurality of charges 70.

According to another embodiment, the transfer unit 310 may include two arc plates 310*a* and 310*b*. The curvature of the arc plates 310*a* and 310*b* may correspond to the curvature of the side surface of each charge 70. When the curvature of the arc plates 310*a* and 310*b* corresponds to the curvature of the side surface of the charge 70, the area of portions of the arc plates 310*a* and 310*b* which support the charge 70 may be maximized. The opening and closing driver may rotate the arc plates 310*a* and 310*b* toward the first housing 100 so as to form a passage through which the charge 70 may be moved between the first housing 100 and the second housing 300. The transfer unit 310 may surround the side surface of the charge 70 to minimize the motion of the charge 70 when the charge 70 is moved to the first housing 100 and guide the charge 70 be arranged in the center of a first support 131 of the first housing 100.

According to still another embodiment, the transfer unit 310 may include a single plate, and the opening and closing driver may slide the single plate to move the charge 70 to the first housing 100.

Figure 4:
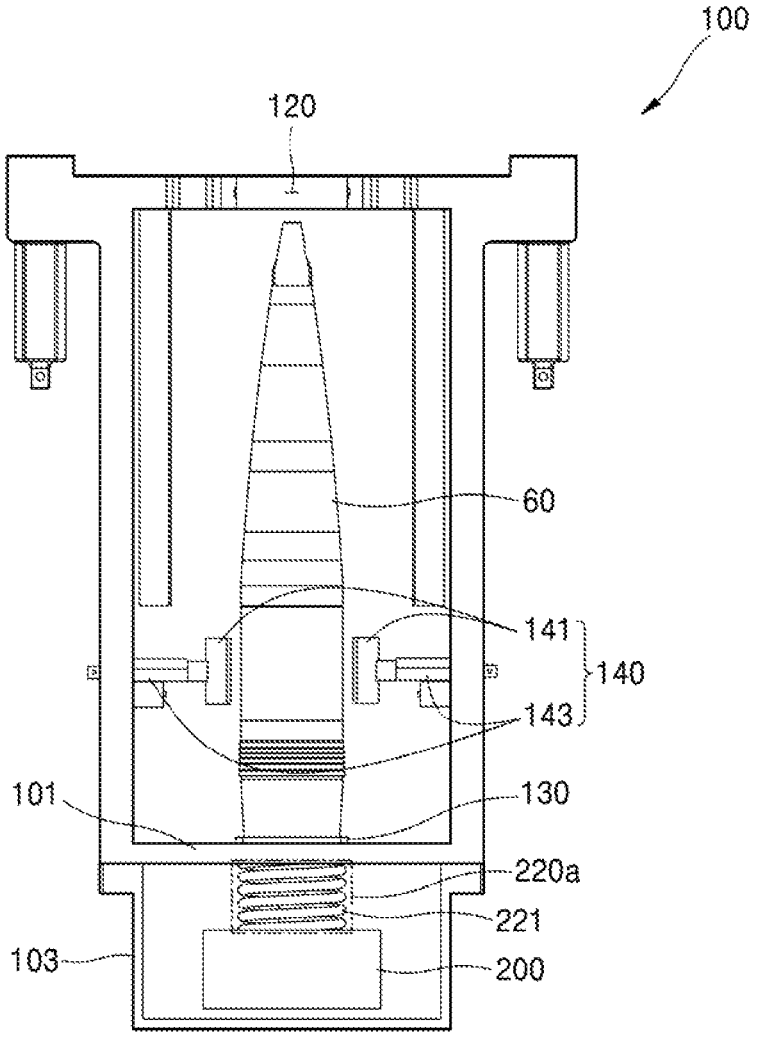
FIG. 4 is a front view of the first housing shown in FIG. 1, according to an embodiment of the present disclosure.

FIG. 4 is a front view of the first housing shown in FIG. 1, according to an embodiment of the present disclosure.

Referring to FIG. 4, the first housing 100, a first support 130, a guide unit 140, and the driving unit 200.

The first support 130 is located inside the first housing 100. A top surface of the first support 131 on which the shell 60 or the charge 70 is seated is flat. The shell 60 or the charge 70 is seated on the top surface. The first support 130 may be connected to the driving unit 200 and linearly moved by the driving force of the driving unit 200. The top surface of the first support 130 may have circular or polygonal shape. The top surface of the first support 130 may have a diameter or a side length greater than the diameter of the shell 60 or the charge 70 so that the shell 60 or the charge 70 may be stably seated on the top surface. The first support 131 is installed to be moved up and down in the first housing 100, thereby linearly moving the shell 60 or the charge 70, which has been seated thereon, lengthwise. A bottom surface of the first support 130 may be connected to the driving unit 200, and the driving unit 200 may linearly move the first support 130.

According to an embodiment, a hole is formed in a bottom surface 101 of the first housing 100. A frame 103 housing the driving unit 200 is located at the bottom surface 101 of the first housing 100. The side length or diameter of the hole is less than that of the first support 130. In this case, the first support 130 may be located across the hole not passing through the hole. The first support 130 is connected to the driving unit 200 through the hole.

The driving unit 200 may be located between the first housing 100 and the first support 130 and may provide a driving force to the first support 130 to linearly move the first support 130. The driving unit 200 may include a first driving unit 210 having the torque of a motor, hydraulic pressure, pneumatic pressure, or magnetic force as the driving force.

The guide unit 140 is located at an inner side of the first housing 100 and includes two guide plates 141 and two motion driving portions 143. The guide plates 141 are arc plates having curvature corresponding to the curvature of the side surface of the charge 70 and the shell 60. The motion driving portions 143 linearly move the guide plates 141 and may include a hydraulic, pneumatic or linear motor. The guide plates 141 are located to face each other. The guide plates 141 may be moved by the motion driving portions 143 to be close to or far away from each other. The motion driving portions 143 may respectively move the guide plates 141 so that the guide plates 141 respectively have corresponding speeds and corresponding moving distances. In this case, the guide unit 140 may correct the position of the charge 70 or the shell 60, which has been seated on the first support 130, so that the charge 70 or the shell 60 is located at the center of the first support 130.

According to an embodiment, the first driving unit 210 may include a hydraulic or pneumatic cylinder which moves a piston or a plunger in linear reciprocating motion using hydraulic or pneumatic pressure. The first driving unit 210 may push the first support 130 using hydraulic or pneumatic pressure so as to linearly move the first support 130. Alternatively, the first driving unit 210 may linearly move the shell 60 or the charge 70 using the torque of the motor. When the first driving unit 210 includes a driving motor, the first driving unit 210 may convert rotary motion into linear motion using a power transmission means and transmit a driving force to the shell 60 or the charge 70. The power transmission means may include a chain, a ball screw, a rack gear, a zipper chain, etc. Although the first driving unit 210 is located at a bottom surface of the first housing 100 in FIG. 5A, the first driving unit 210 may be located inside either the first housing 100 or the second housing 300 as long as the first driving unit 210 is able to transmit a driving force enabling the shell 60 or the charge 70 to move in linear motion. The first driving unit 210 may continuously apply a force to the shell 60 or the charge 70 so as to move the shell 60 or the charge 70 in linear motion and may change the direction of the linear motion by changing the rotation direction of the motor.

The driving unit 200 may also include a second driving unit 220*a* between the first housing 100 and the first support 130. The second driving unit 220*a* applies an elastic force to the first support 130. The second driving unit 220*a* may include a spring 221 which surrounds a portion connecting the first driving unit 210 to the first support 131. The diameter of the spring 221 of the second driving unit 220*a* is smaller than the diameter or side length of the hole. The spring 221 of the second driving unit 220*a* may pass through the hole and apply an elastic force to the first support 130.

According to an embodiment, the spring 221 of the second driving unit 220*a* may be separated from the first support 130. The spring 221 of the second driving unit 220*a* may be separated from the first support 130 after transmitting an elastic force to the first support 130 so as not to hinder the linear motion of the first support 130. After the first support 130 is separated from the spring 221, the first support 130 may be moved linearly by the driving force of the first driving unit 210.

Figure 5A:
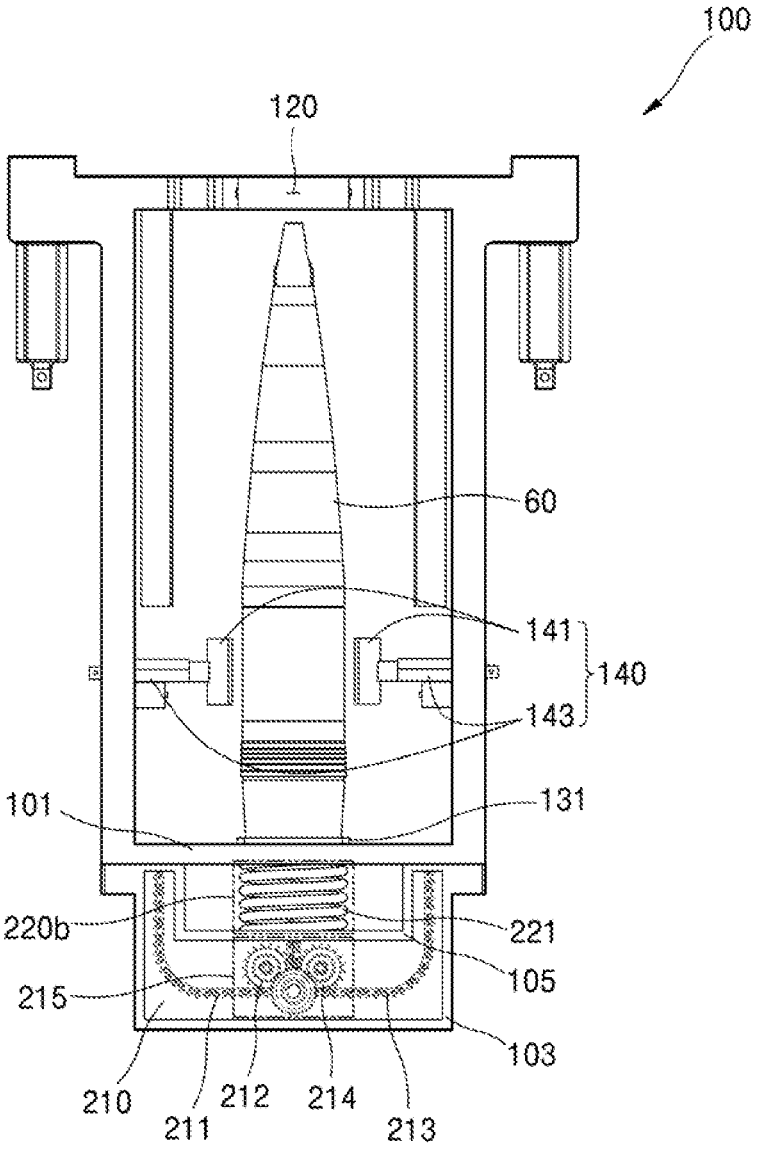
FIG. 5A is a front view of the first housing shown in FIG. 1, according to another embodiment of the present disclosure.
Figure 5B:
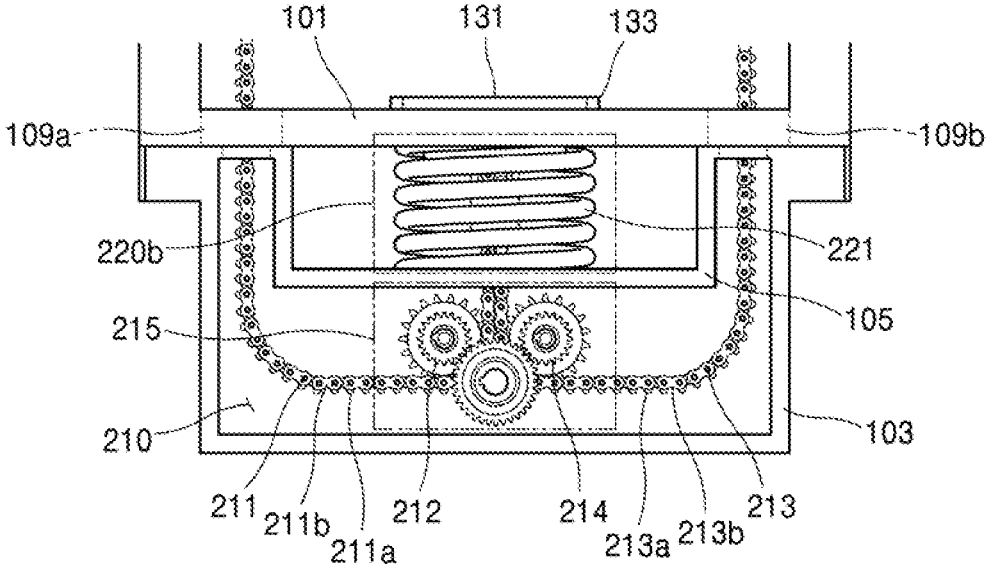
FIG. 5B is a partially enlarged view of a part of the first housing shown in FIG. 5A.

FIG. 5A is a front view of the first housing shown in FIG. 1, according to another embodiment of the present disclosure. FIG. 5B is a partially enlarged view of a part of the first housing shown in FIG. 5A.

Referring to FIGS. 5A and 5B, the first driving unit 210 includes a first chain 211, a second chain 213, and a chain driver 215. A second driving unit 220*b* includes the spring 221. It is assumed hereinafter that a direction in which the shell 60 is linearly moved for loading is a first direction and an opposite direction to the first direction is a second direction.

A first frame 105 housing the second driving unit 220*b* and a second frame 103 housing the first driving unit 210 are located on the bottom surface 101 of the first housing 100. The length of long side of the first frame 105 is shorter than the length of long side of the second frame 103. The second frame 103 is located to surround the first frame 105. The first frame 105 and the second frame 103 are coupled to the bottom surface 101 of the first housing 100 using a bolt or welding. A through-hole through which the first driving unit 210 passes is formed in a surface of the first frame 105. The diameter of the through-hole is smaller than that of the spring 221 so that the spring 221 does not pass through the through-hole.

The first chain 211 and the second chain 213 are connected to the first support 131. The first chain 211 and the second chain 213 are located to face each other. A connection gap, i.e., a groove 211*b* of the first chain 211 engages with a second protrusion 213*a* of the second chain 213, and a first protrusion 211*a* of the first chain 211 engages with a groove 213*b* of the second chain 213. The first chain 211 and the second chain 213 may combine to form a zipper chain and stand straight by themselves in a moving direction by counterbalancing and stabilizing the horizontal component of a force. The first chain 211 and the second chain 213 form a shape corresponding to a 90-degree rotated "E" in the second frame 103. Opposite ends of the first chain 211 and the second chain 213 move in different directions such that respective ends of the first and second chains 211 and 213 connected to the first support 131 move in the first direction while the other respective ends of the first and second chains 211 and 213 move in the second direction.

According to an embodiment, a first chain through-hole 109*a* and a second chain through-hole 109*b* are formed in the bottom surface 101 of the first housing 100. A portion of the first chain 211 may pass through the first chain through-hole 109*a*. A portion of the second chain 213 may pass through the second chain through-hole 109*b*. Even though the length of the first and second chains 211 and 213 are greater than the circumference of the second frame 103, the first and second chains 211 and 213 may linearly move in the first housing 100 through the first and second chain through-holes 109*a* and 109*b*, respectively. In other words, the length of the first and second chains 211 and 213 is not limited by the circumference of the second frame 103.

The chain driver 215 includes a first sprocket 212 and a second sprocket 214, which rotate in opposite directions. The first sprocket 212 engages with one of the first and second chains 211 and 213 and the second sprocket 214 engages with the other one of the first and second chains 211 and 213. Although not shown, the chain driver 215 may also include a fixing unit (not shown) such that the first and second chains 211 and 213 are fixed by the fixing unit no to move. The chain driver 215 may allow the first and second chains 211 and 213 to engage with each other to be in a rigid state or separate engaged portions of the first and second chains 211 and 213 from each other. For example, the chain driver 215 may engage the first and second chains 211 and 213 with each other so that the first and second chains 211 and 213 become rigid and may apply a force to the first support 131. In this case, the chain driver 215 may linearly move the first support 131 in the first direction. The chain driver 215 may separate the engage portions of the first and second chains 211 and 213 from each other and linearly move the first support 131 in the second direction.

The second driving unit 220*b* is located at the first housing 100. The spring 221 of the second driving unit 220*b* is in contact with a second support 133 and is bound to the first frame 105. The spring 221 of the second driving unit 220*b* may be supported by the first frame 105 and may pass through the hole formed in the bottom surface 101 of the first housing 100. The spring 221 may be maintained in a compressed state by the first support 131.

According to an embodiment, the second driving unit 220*b* may apply a force to the first support 131 together with the first driving unit 210. A necessary force to load the shell 60 may be embodied by the resultant force of the first driving unit 210 and the second driving unit 220*b*. For example, when the shell 60 is loaded by linearly moving the first support 131 using the first driving unit 210, significantly large torque of a motor or hydraulic or pneumatic pressure may be required. In this case, the size and cost of the motor or hydraulic or pneumatic equipment of the first driving unit 210 may be greatly increased. Accordingly, when the driving unit 200 further includes the second driving unit 220*b* including an elastic body, a burden to the first driving unit 210 may be decreased. Meanwhile, the second driving unit 220*b* may include the spring 221. Before the loading of the shell 60, the spring 221 of the second driving unit 220*b* may be compressed so that the second driving unit 220*b* has an elastic force by the first driving unit 210.

Figure 6:
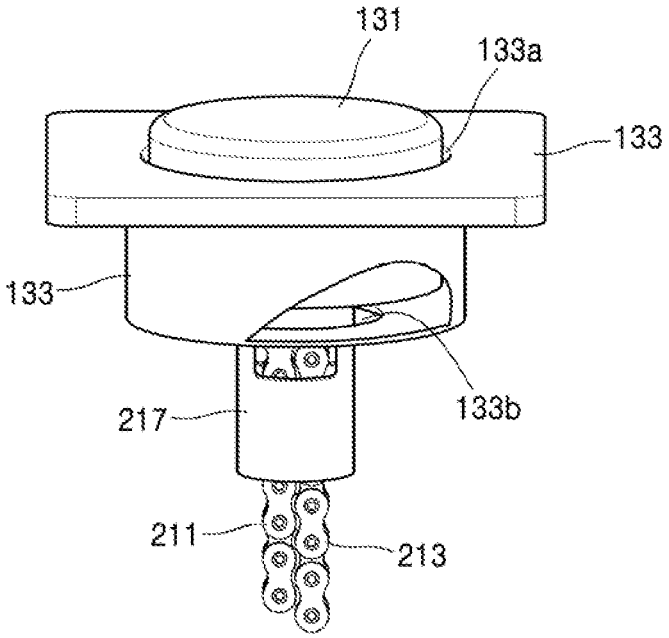
FIG. 6 is a perspective view of a first support and a second support shown in FIG. 5A.

FIG. 6 is a perspective view of a first support and a second support shown in FIG. 5A. FIG. 6 partially shows an interior of the second support.

Referring to FIG. 6, the first support 131 is inserted in the second support 133. Referring to the interior of the second support 133, the first support 131 is bound to the first and second chains 211 and 213. When the first support 131 is completely inserted in a first recess 133*a* of the second support 133, surfaces of the first support 131 and the second support 133, on which the shell 60 is seated, may be form one plane. In this case, the first support 131 is supported by the second support 133.

The second support 133 includes a surface on which the shell 60 or the charge 70 is seated. An insertion recess, i.e., the first recess 133*a* is formed in the surface 133*c*. The diameter of the insertion recess 133*a* is greater than that of the first support 131. The first support 131 may be inserted in the insertion recess 133*a*. When the first support 131 is inserted in the insertion recess 133*a*, the insertion recess 133*a* surrounds a lateral surface of the first support 131. A bottom surface of the insertion recess 133*a* may support the first support 131. A driving through-hole 133*b* is formed in one surface of the insertion recess 133*a*. The diameter of the driving through-hole 133*b* is smaller than that of the first support 131 so that the first support 131 does not escape downward from the second support 133. The diameter of the driving through-hole 133*b* is greater than that of a chain guide 217. A portion of the chain guide 217 passes through the driving through-hole 133*b* and is bound to the first support 131. A side length of the surface 133*c* of the second support 133 is greater than the diameter of the insertion recess 133*a*. The diameter of the spring 221 (in FIG. 5) is less than the side length of the surface 133*c* but greater than the diameter of the insertion recess 133*a*. In this case, the spring 221 (in FIG. 5) is located to border a surface facing the surface 133*c* of the second support 13. The spring 221 (in FIG. 5) may be located close to a lateral side of the insertion recess 133*a* so that the spring 221 (in FIG. 5) is prevented from bending in a direction different from a direction in which an elastic force is transmitted. In other words, the spring 221 (in FIG. 5) may transmit the elastic force to the second support 133 in a more accurate direction when the elastic force is transmitted through the surface facing the surface 133*c* than when the spring 221 (in FIG. 5) borders one surface of the insertion recess 133*a*.

The chain guide 217 prevents upper engaged portions of the first and second chains 211 and 213 from moving in a direction vertical to the direction of the linear motion thereof. The chain guide 217 surrounds a portion at which the first and second chains 211 and 213 are bound to the first support 131. The chain guide 217 can hold the engaged portions of the first and second chains 211 and 213 so that the direction of the linear motion of the engaged portions is not changed.

Figure 7A:
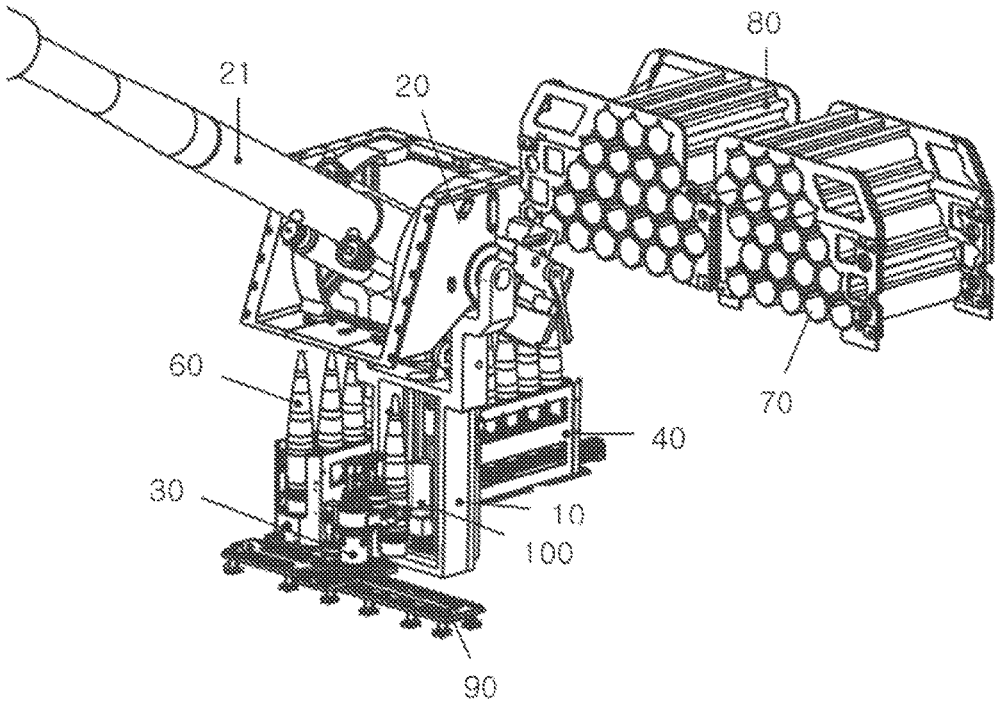
FIGS. 7A to 7C are drawings showing an operation of inserting a shell and a charge using the combined loading device shown in FIG. 1.
Figure 7B:
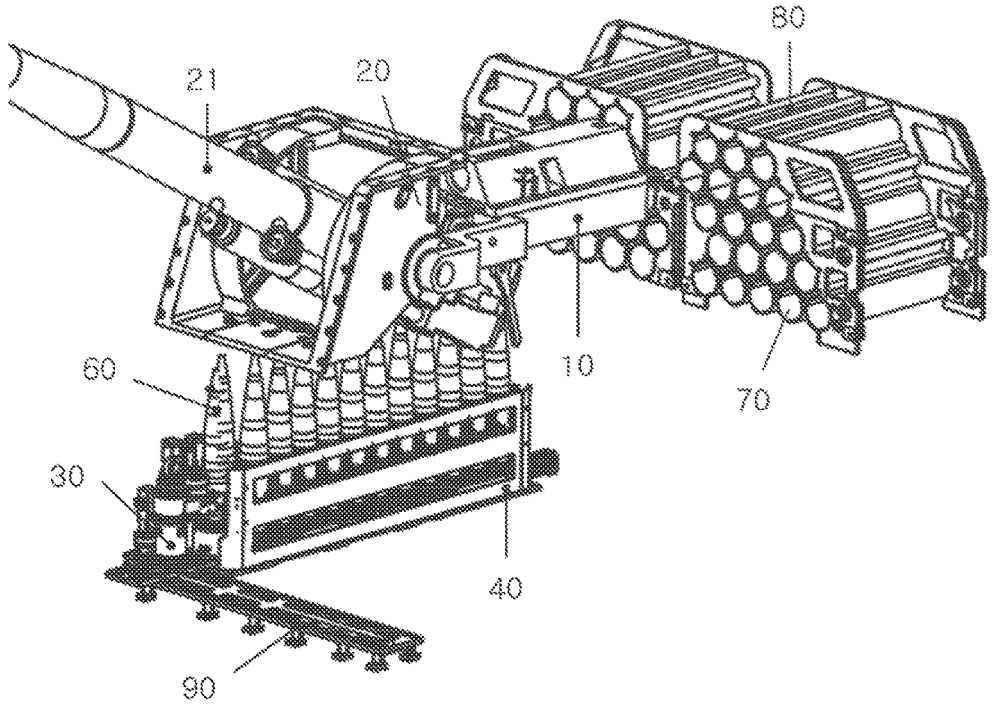

FIGS. 7A to 7B are drawings showing the operation of inserting a shell and a charge using the combined loading device shown in FIG. 1.

Figure 7C:
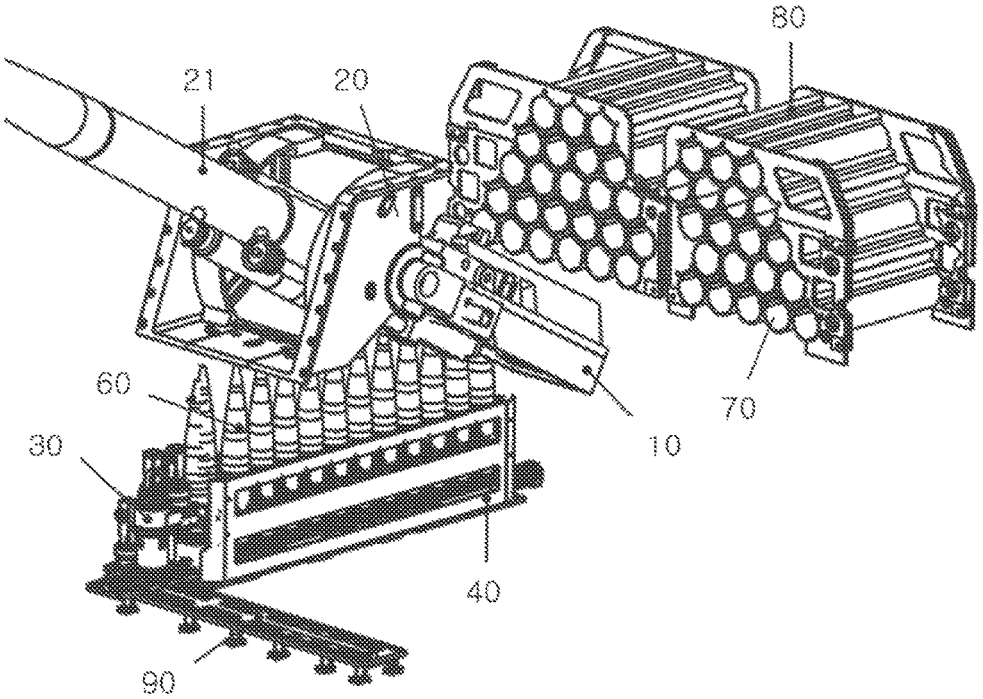
Figure 8A:
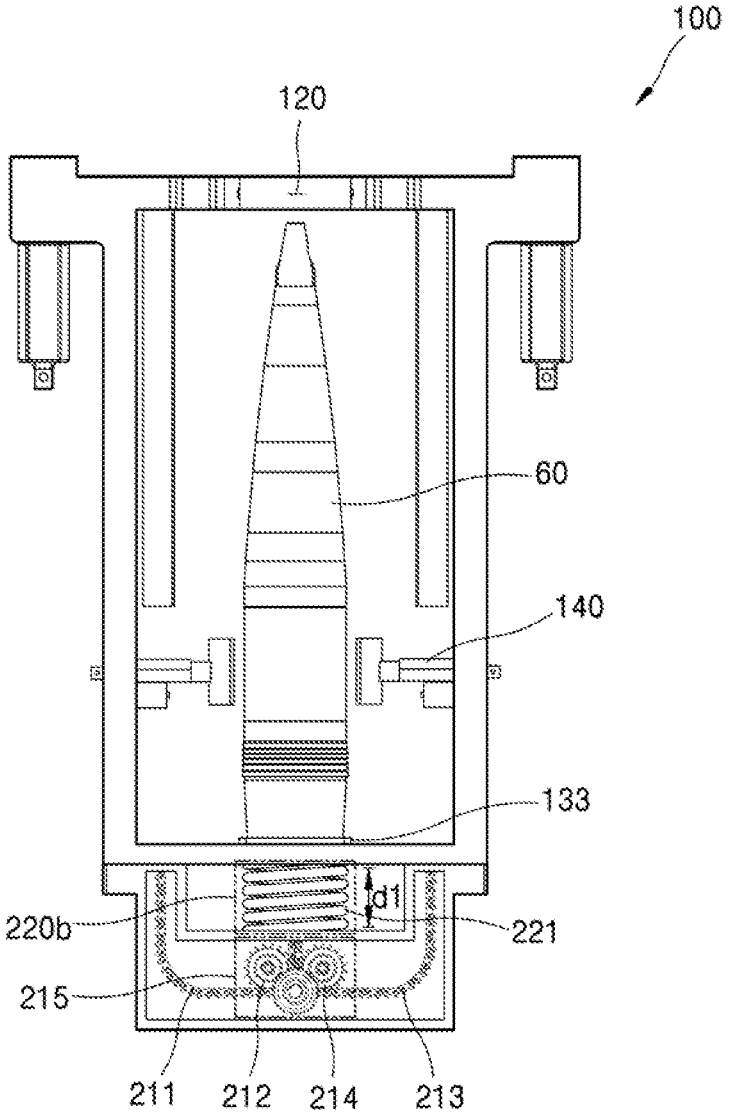
FIGS. 8A to 8D are drawings showing an operation of loading a shell using the combined loading device shown in FIG. 1.
Figure 8B:
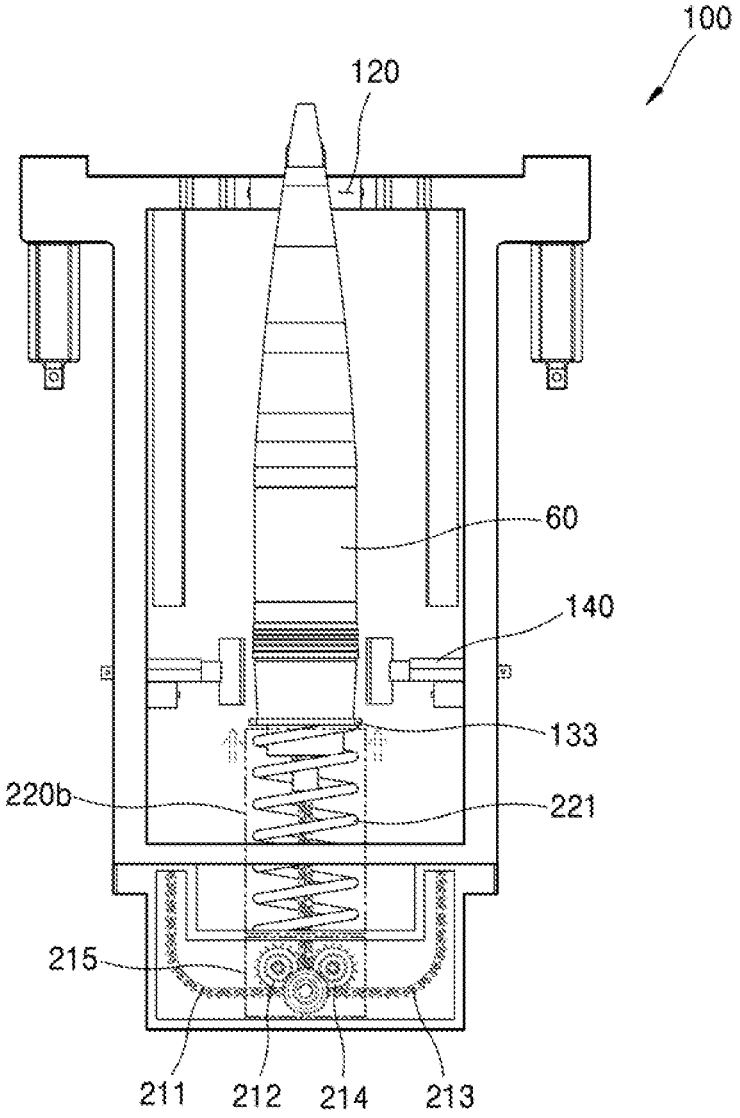
Figure 8C:
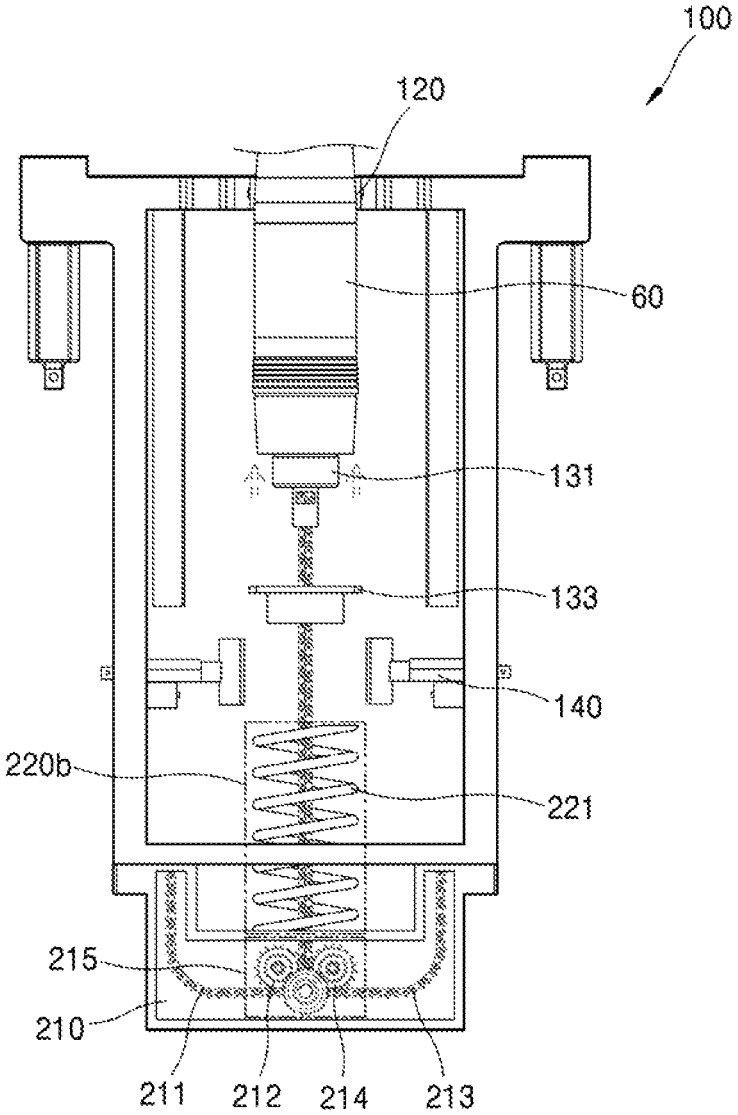
Figure 8D:
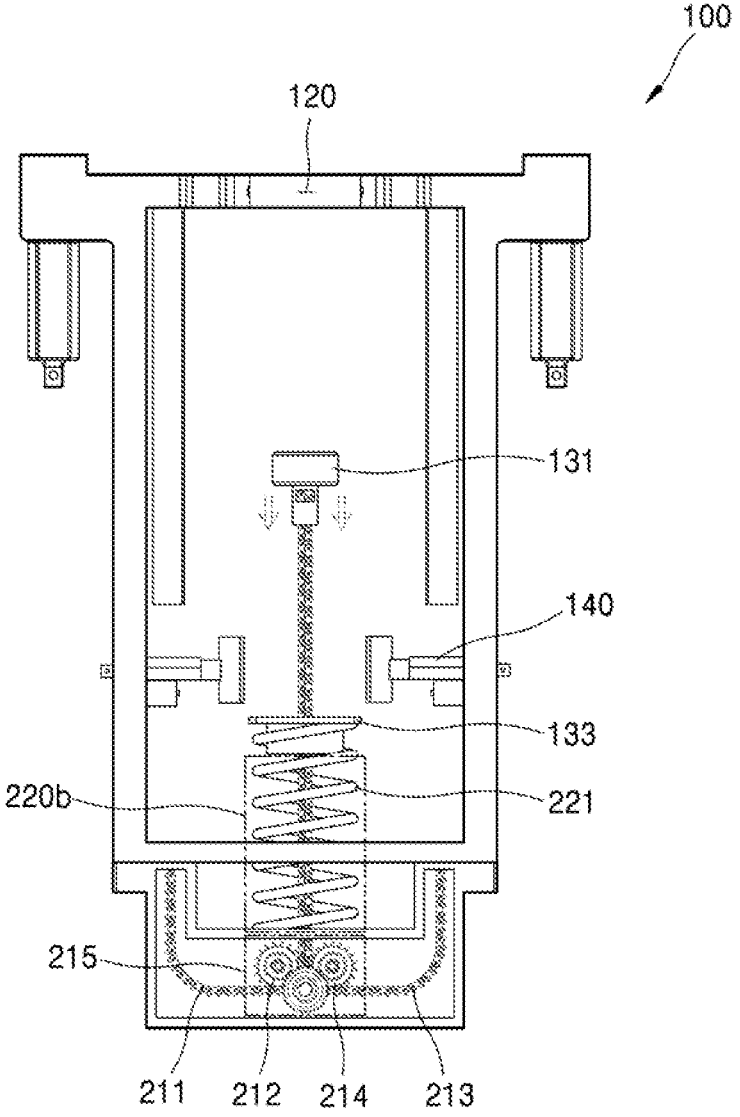
Figure 9A:
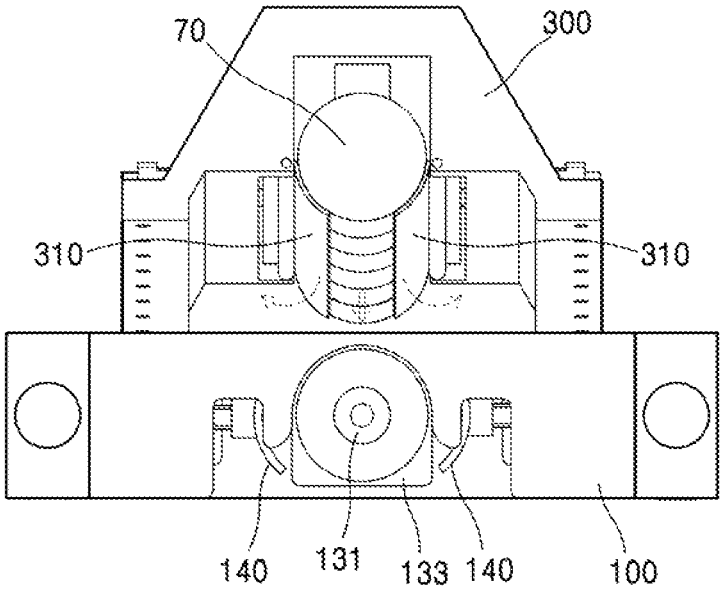
FIGS. 9A to 9E are drawings showing an operation of loading a charge using the combined loading device shown in FIG. 1, according to an embodiment of the present disclosure.
Figure 9B:
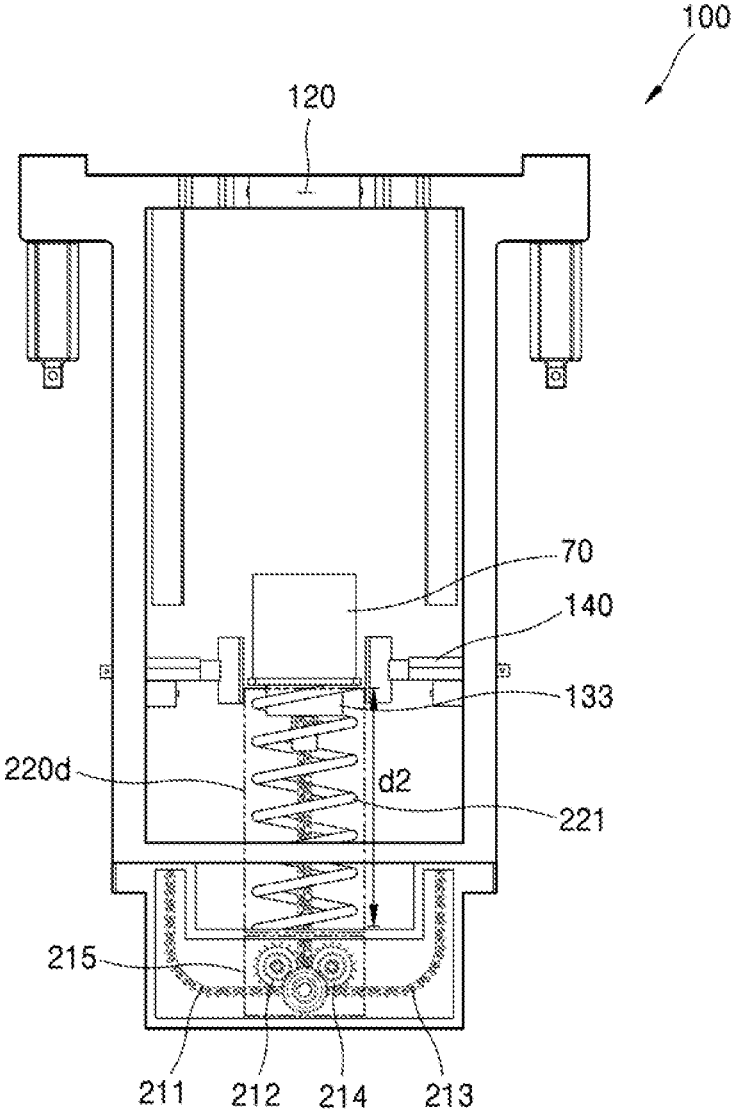
Figure 9C:
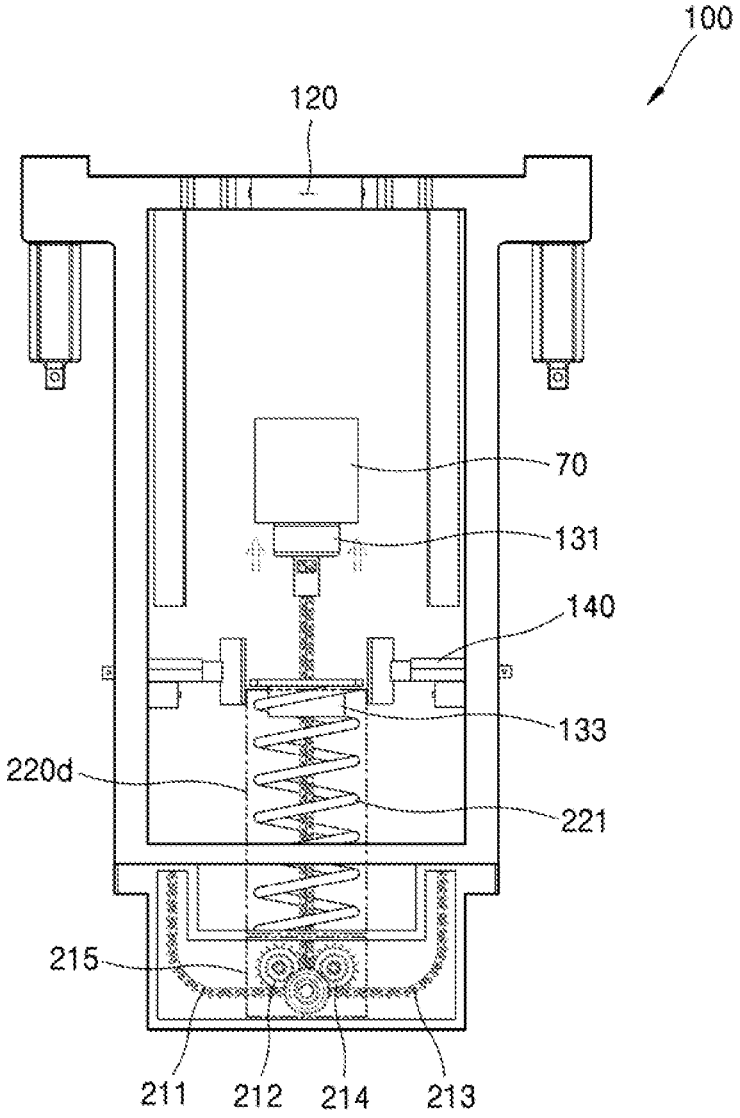
Figure 9D:
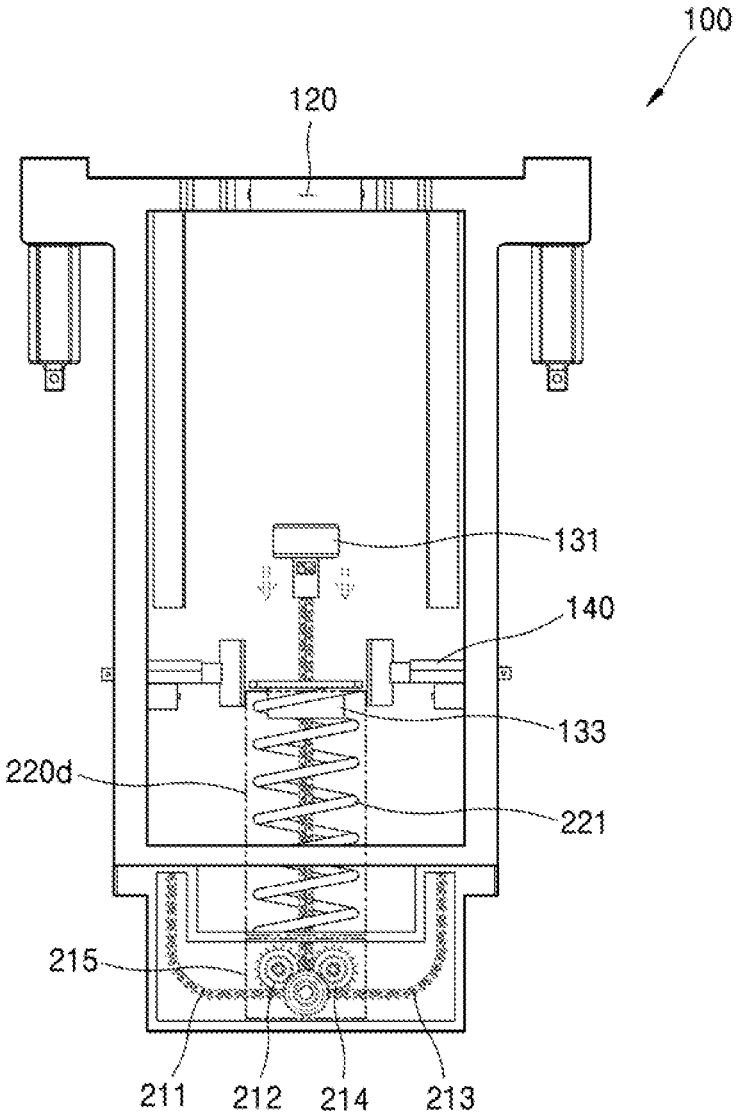
Figure 9E:
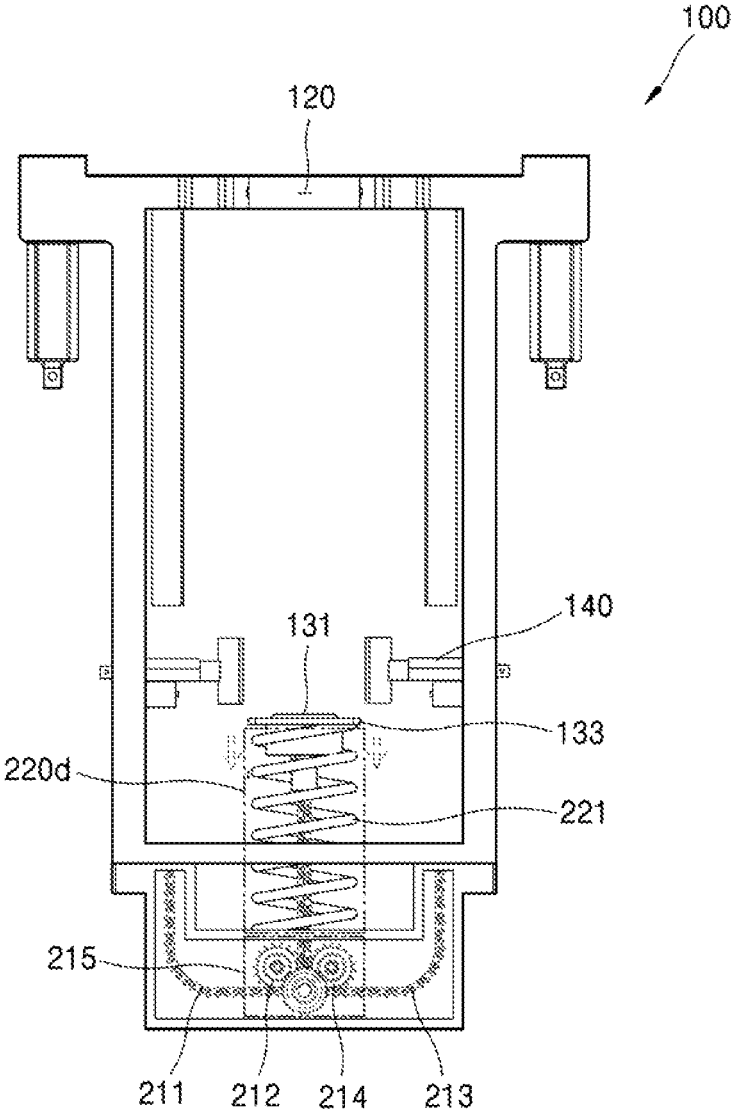

Referring to FIGS. 7A through 7C, the combined loading device 10 rotates to be vertical to the ground surface for the insertion of the shell 60. The automatic shell transfer device 30 grabs the shell 60 and moves along the shell transfer rail 90 to a position facing the combined loading device 10. The automatic shell transfer device 30 pushes the shell 60 into the first housing 100 of the combined loading device 10. When the shell 60 is inserted in the combined loading device 10, the combined loading device 10 rotates to be horizontal to the ground surface. When the combined loading device 10 is horizontal to the ground surface, the automatic charge transfer rack 80 pushes the charge 70 into the combined loading device 10. At this time, a plurality of charges 70 may be inserted in the combined loading device 10 according to the flight distance of the shell 60. When at least one charge 70 is inserted in the combined loading device 10, the combined loading device 10 rotates to be aligned with the length direction of the gun barrel 21.

FIGS. 8A to 8D are drawings showing the operation of loading a shell using the combined loading device shown in FIG. 1.

Referring to FIGS. 8A to 8D, the second support 133 is fixed by the first support 131 such that the spring 221 of the second driving unit 220*b* maintains an elastic force in a compressed state. The shell 60 has been inserted into a side of the first housing 100 and seated on the first support 131 and the second support 133. The shell 60 is located at the center of the first support 131 and the second support 133 by the guide unit 140 so that the shell 60 may pass through the through-hole 120 (see FIG. 8A).

When the first driving unit 210 linearly moves the first support 131 by applying a driving force, the second driving unit 220*b* applies accumulated energy (e.g., an elastic force) to the second support 133. The second support 133 starts linear motion due to the elastic force of the second driving unit 220*b* and, as described with reference to FIG. 6, pushes the first support 131. At this time, the driving force of the first driving unit 210 and the elastic force of the second driving unit 220*b* are applied together to the shell 60 (see FIG. 8B).

The second support 133 is separated from the spring 221 of the second driving unit 220*b*, and the speed of the linear motion of the second support 133 in the first direction is decreased. The driving force of the first driving unit 210 is continuously applied to the first support 131. The first support 131 continuously transmits the driving force to the shell 60 while guiding the shell 60 to the gun barrel 21. Since the speed of the second support 133 is decreased while the speed of the first support 131 is maintained or increased, the first support 131 is separated from the second support 133 (see FIG. 8C).

The first support 131 pushes the shell 60 into the gun barrel 21. When the shell 60 is inserted and loaded into the gun barrel 21, the first support 131 stops the linear motion in the first direction. The chain driver 215 of the first driving unit 210 reverses the rotation direction thereof so that the engaged portions of the first and second chains 211 and 213 are separated from each other. At this time, the first support 131 linear moves in the second direction and stops at a position where the charge 70 transferred from the second housing 300 to the first housing 300 may be seated (see FIG. 8D).

According to an embodiment, the first support 131 is connected to the first driving unit 210 and linearly moves in subordination to the linear motion of the first driving unit 210. The second support 133 supports the shell 60 or the charge 70 while supporting the first support 131. When the first support 131 starts linear motion due to a driving force of the first driving unit 210, the spring 221 of the second driving unit 220*b* linearly moves the second support 133 by applying an elastic force to the second support 133. The second support 133 transmits the elastic force to the first support 131 to push out the first support 131. At this time, the shell 60 is linearly moved by the driving force of the first driving unit 210 and the elastic force of the second driving unit 220*b*. While the first support 131 continuously receives the driving force of the first driving unit 210, the second support 133 does not receive the elastic force after being separated from the second driving unit 220*b*. The first support 131 is accelerated by the driving force of the first driving unit 210, but the second support 133 is decelerated. Accordingly, the first support 131 is separated from the second support 133. For example, the first support 131 may guide the shell 60 to the through-hole 120 while transmitting the driving force of the first driving unit 210 to the shell 60.

FIGS. 9A to 9E are drawings showing the operation of loading a charge using the combined loading device shown in FIG. 1, according to an embodiment of the present disclosure.

Referring to FIGS. 9A to 9E, in a procedure for seating the charge 70 on the first support 131, the arc plates 310*a* and 310*b* of the transfer unit 310 rotate toward the lateral sides of the first housing 100. The charge 70 loaded into the second housing 300 is transferred to the first housing 100 due to the rotation of the transfer unit 310. The charge 70 transferred to the first housing 100 may be seated on the first support 131. The charge 70 may be located at the center of the first support 131 by the guide unit 140 (see FIG. 9A).

The charge 70 is seated on the first support 131 in a state where the spring 221 of the second driving unit 220*b* is not compressed. Since the hardness and mass of the charge 70 are lower than those of the shell 60, the charge 70 may be damaged when the forces of the first driving unit 210 and the second driving unit 220*b* are applied to the charge 70 as they are applied to the shell 60. The charge 70 needs to be loaded using a force less than the force used when the shell 60 is loaded. To prevent damage to the charge 70, the combined loading device 10 seats the charge 70 on the first support 131 in a state where the spring 221 of the second driving unit 220*b* is not compressed (see FIG. 9B).

The first support 131 starts linear motion in the first direction due to the driving force of the first driving unit 210. At this time, the second support 133 is at a standstill since no driving force or elastic force is applied thereto, and the first support 131 is separated from the second support 133 and linear moves the charge 70. The first support 131 continuously applies the driving force of the first driving unit 210 to the charge 70 while guiding the charge 70 to the through-hole 120 until the charge 70 enters the gun barrel 21 (see FIG. 9C).

The chain driver 215 of the first driving unit 210 reverses the rotation direction thereof so as to move linearly the first support 131 in the second direction. The first support 131 is surrounded by the second support 133 and transmits the driving force of the first driving unit 210 to the second support 133 so that the first support 131 and the second support 133 start linear motion together. The second support 133 is in contact with the spring 221 of the second driving unit 220*b*. The second support 133 compresses the spring 221 of the second driving unit 220*b* using the driving force received by the first support 131 (see FIG. 9D).

The first driving unit 210 stops the chain driver 215 when the length of the spring 221 of the second driving unit 220*b* reaches an initial length which the spring 221 has when the shell 60 is seated on the first support 131. The first support 131 and the second support 133 are fixed, so that second driving unit 220*b* is maintained in the compressed state (see FIG. 9E).

The weight and hardness of the charge 70 are lower than those of the shell 60. When a force applied to the shell 60 to load the shell 60 is applied to the charge 70, the charge 70 is in danger of being damaged or exploding. To prevent the charge 70 from being damaged, the charge 70 is usually loaded into the gun barrel 21 (in FIG. 1) using a human force or a separate device for loading the charge 70 with a right force. According to an embodiment, the combined loading device 10 includes the first driving unit 210 and the second driving unit 220*b* so as to use different forces, respectively, when the charge 70 is loaded and when the shell 60 is loaded. The mass and hardness of the shell 60 are higher than those of the charge 70. The shell 60 is loaded using forces of the first and second driving units 210, 220*b* together. The charge 70 is loaded using a force of one of the first and second driving units 210 and 220. Since the charge 70 may be loaded using a driving force of a single appropriate driving unit, the charge 70 is loaded without fear of explosion or damage. For example, when the first driving unit 210 has a driving force of 50 N and the second driving unit 220 has an elastic force of 50 N in a case where a force of 80 N is needed to load the shell 60 and a force of 50 N is needed to safely load the charge 70 without damage, the combined loading device 10 may load the charge 70 using either the driving force of the first driving unit 210 or the elastic force of the second driving unit 220.

According to an embodiment, when the shell 60 is loaded, the charge 70 in a second housing may be quickly transferred to a first housing. To complete loading, the charge 70 needs to be completely loaded. The charge 70 is located at a first support of the first housing and is loaded into the gun barrel 21 (in FIG. 1) by the driving force of the first driving unit 210. Since the charge 70 may also be loaded using one combined loading device, firing may be quickly prepared. In addition, the combined loading device can load the charge 70 while maintaining the arrangement with the gun barrel 21 (in FIG. 1) in which the combined loading device has loaded the shell 60. For example, after the shell 60 is loaded, the charge 70 is usually loaded using a separate automatic loading device for the charge 70 or a human force. In this case, a device used to load the shell 60 is removed and the separate device is coupled to the gun barrel 21 (in FIG. 1) or a human force is used to insert the charge 70 in the gun barrel 21 (in FIG. 1). When the separate device is used to load the charge 70, the separate device needs to be located such that the separate device is in line with the length direction of the gun barrel 21 (in FIG. 1) and a through-hole is in contact with a hole of the gun barrel 21 (in FIG. 1). Since the combined loading device can load the charge 70 without changing the position at which the combined loading device has been when loading the shell 60, the charge 70 may be quickly loaded.

Figure 10A:
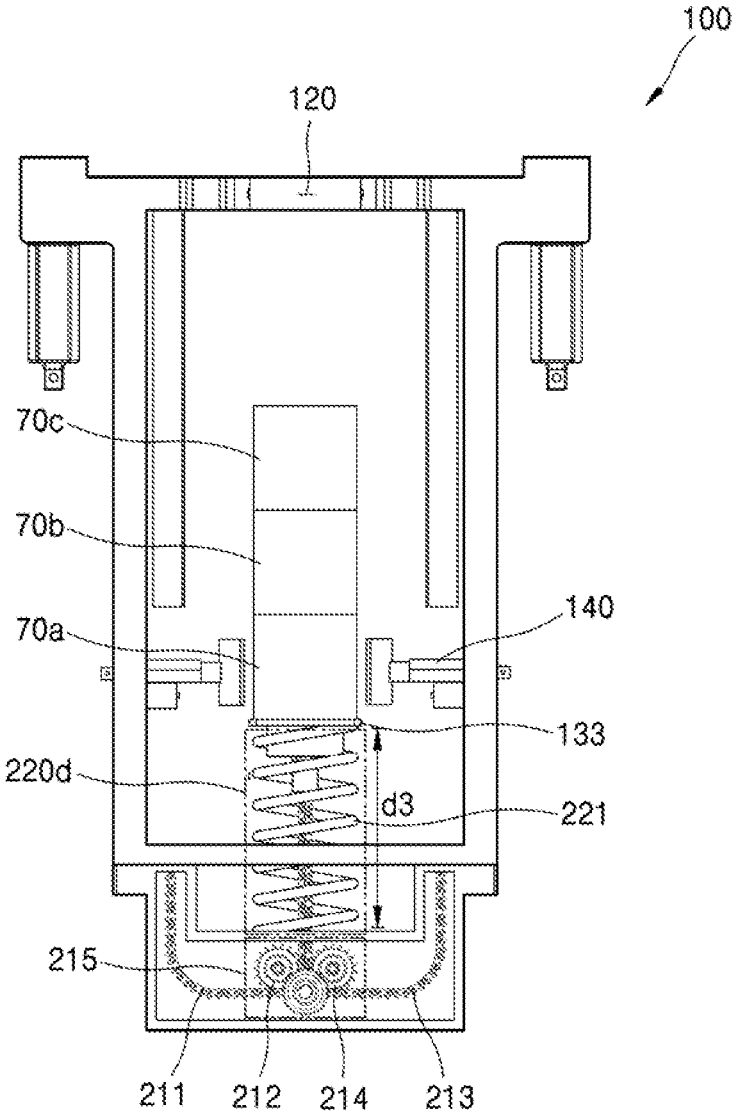
FIGS. 10A to 10B are drawings showing an operation of loading a charge using the combined loading device shown in FIG. 1, according to another embodiment of the present disclosure.
Figure 10B:
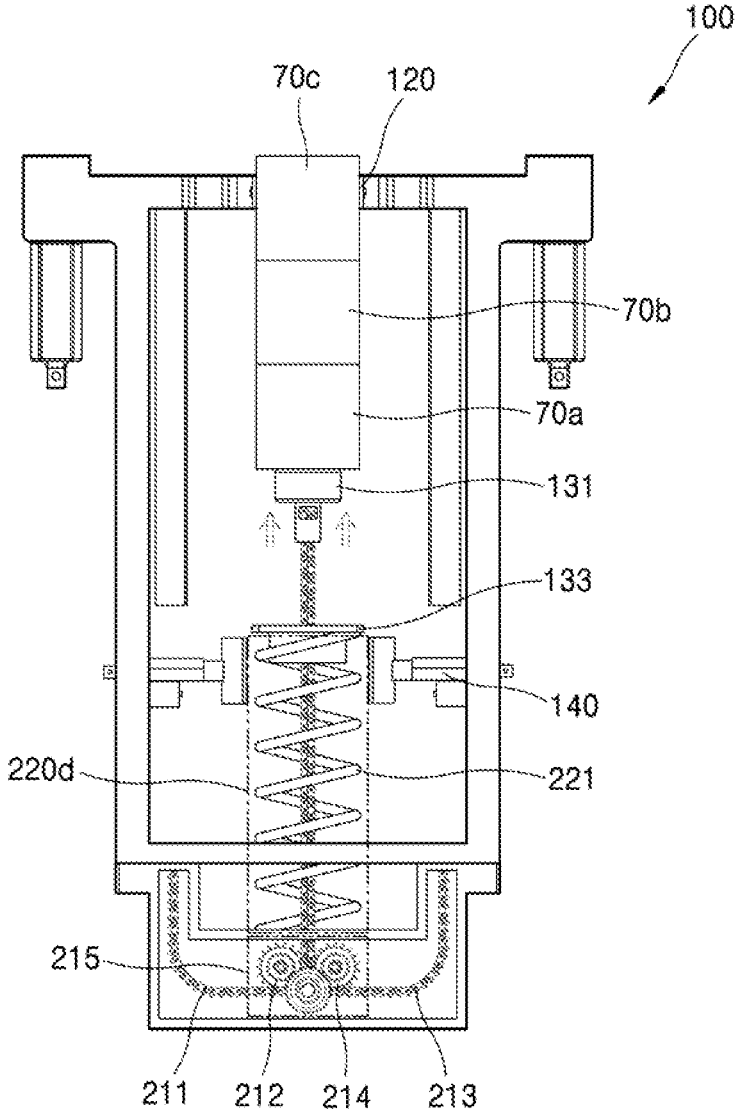

FIGS. 10A and 10B are drawings showing the operation of loading a charge using the combined loading device shown in FIG. 1, according to another embodiment of the present disclosure.

Referring to FIG. 10A, the first support 131 supports a plurality of charges 70. A length d3 of the spring 221 of the second driving unit 220*b* is less than a length d2 of the spring 221 of the second driving unit 220*b* in FIG. 9B. When the number of charges 70 to be loaded exceeds a predetermined value, the driving force of the first driving unit 210 only may not be enough to appropriately load the charges 70. In this case, the first driving unit 210 linearly moves the first and second supports 131 and 133 in the second direction to a certain position so that the spring 221 of the second driving unit 220*b* is compressed to have a predetermined elastic force. The charges 70 can receive the driving force of the first driving unit 210 and the predetermined elastic force of the second driving unit 220*b*.

According to an embodiment, the combined loading device 10 may control the compression of the spring 221 of the second driving unit 220*b* according to the number of charges 70 seated on the first support 131, thereby adjusting a force applied to the charges 70. The charges 70 are gunpowder which provides energy needed to propel the shell 60. The number of charges 70 to be loaded may vary with the flight distance of the shell 60. A plurality of charges 70 may need to be loaded and loading the plurality of charges 70 may need a greater force than loading a single charge 70. In this case, a force applied to the charges 70 may be adjusted by controlling the elastic force of the second driving unit 220*b*. For example, when the number of charges 70 to be loaded exceeds a predetermined value, the first support 131 may press down the spring 221 of the second driving unit 220*b* to a certain position. However, the length d3 of the spring 221 of the second driving unit 220*b* is greater than a length d1 of the spring 221 of the second driving unit 220*b*, the spring 221 of the second driving unit 220*b* having the length d1 when the shell 60 is loaded.

Referring to FIG. 10B, when the first driving unit 210 linearly moves the first support 131 by applying a driving force to the first support 131, the second driving unit 220*b* applies accumulated energy (e.g., an elastic force) to the second support 133. The second support 133 starts to be linearly moved by the elastic force of the second driving unit 220*b* and pushes the first support 131. At this time, the driving force of the first driving unit 210 and the elastic force of the second driving unit 220*b* are applied together to the charges 70, and the charges 70 are linearly moved in the same direction as the first and second supports 131 and 133. The driving force of the first driving unit 210 is continuously applied to the first support 131, so that the speed of linear motion of the first support 131 is maintained or increased. After the second support 133 is separated from the spring 221, the speed of the second support 133 is decreased, and the second support 133 is separated from the first support 131. The first support 131 applies the driving force to the charges 70 and guides the charges 70 to the through-hole 120 so as to load the charges 70 into the gun barrel 21.

While this present disclosure has been particularly shown and described with reference to preferred embodiments thereof, it will be understood by those skilled in the art that various changes in form and details may be made therein without departing from the spirit and scope of the present disclosure as defined by the appended claims. The preferred embodiments should be considered in descriptive sense only and not for purposes of limitation. Therefore, the scope of the present disclosure is defined not by the detailed description of the present disclosure but by the appended claims, and all differences within the scope will be construed as being included in the present disclosure.

The invention claimed is:

1. A combined loading device comprising:

a first housing in which a shell is inserted;

a second housing in which a charge is inserted, the second housing being connected to the first housing and configured to transfer the charge to the first housing;

a first support located in the first housing and configured to allow the shell or the charge to be seated and linearly moved; and a driving unit located inside the first housing, connected to the first support, and configured to move the first support on which the shell is seated, wherein the second housing comprises a transfer unit, wherein the second housing is located higher than the first housing with respect to a ground, and wherein the transfer unit is configured to transfer the charge from the second housing to the first support using gravity such that the charge is seated on the first support.

2. The combined loading device of claim 1, wherein the driving unit comprises a first driving unit connected to the first support and configured to linearly move the first support.

3. The combined loading device of claim 2, wherein the driving unit further comprises a second driving unit located between the first housing and the first support and configured to move the first support via an elastic force.

4. The combined loading device of claim 1, further comprising a second support at an outer surface of the first support.

5. The combined loading device of claim 4, wherein the driving unit comprises a first driving unit located between the second support and one surface of the first housing and configured to move the first support.

6. The combined loading device of claim 5, wherein the driving unit comprises a second driving unit located between the second support and the first housing and configured to apply an elastic force to the second support.

7. The combined loading device of claim 5, wherein the first driving unit comprises:

a first chain connected to the first support;

a second chain connected to the first support and located to face the first chain; and a chain driver configured to combine the first chain and the second chain into a zipper chain and apply a force to the first support.

8. A combined loading method comprising:

inserting a shell into an opening of a first housing and seating the shell on a support;

inserting a charge in a second housing connected to the first housing;

loading the shell into a gun barrel by linearly moving the support on which the shell is seated;

seating the charge on the support; and loading the charge into the gun barrel by linearly moving the support on which the charge is seated, wherein the second housing comprises a transfer unit, wherein the second housing is located higher than the first housing with respect to a ground, and wherein the transfer unit is configured to transfer the charge from the second housing to the support using gravity such that the charge is seated on the support.

9. The combined loading method of claim 8, wherein a force applied to the support when the charge is loaded is less than a force applied to the support when the shell is loaded.

* * * * *